US008539869B2

(12) United States Patent
Flood et al.

(10) Patent No.: US 8,539,869 B2
(45) Date of Patent: Sep. 24, 2013

(54) GUILLOTINE CUTTER

(75) Inventors: Brian Flood, Medford, WI (US); Kerry Anderson, Houlton, WI (US); Douglas R. Kremers, Champlin, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 821 days.

(21) Appl. No.: 12/364,776

(22) Filed: Feb. 3, 2009

(65) Prior Publication Data

US 2010/0192746 A1 Aug. 5, 2010

(51) Int. Cl.
*B26D 7/00* (2006.01)

(52) U.S. Cl.
USPC ..... 83/111; 83/694; 83/697

(58) Field of Classification Search
USPC ..... 83/694, 697, 607–612, 636, 111–113
See application file for complete search history.

(56) References Cited

U.S. PATENT DOCUMENTS

| | | | | |
|---|---|---|---|---|
| 3,800,646 | A * | 4/1974 | Benz | 83/320 |
| 3,918,339 | A * | 11/1975 | Cailloux | 83/611 |
| 4,398,441 | A * | 8/1983 | Jue | 83/607 |
| 4,436,163 | A * | 3/1984 | Simpson | 173/117 |
| 5,408,908 | A * | 4/1995 | Rosenthal et al. | 83/584 |
| 5,613,788 | A | 3/1997 | Dobring | |
| 5,647,261 | A * | 7/1997 | Wierenga | 83/694 |
| 5,727,889 | A | 3/1998 | Koyabu | |
| 5,971,639 | A | 10/1999 | Park | |
| 5,980,546 | A | 11/1999 | Hood | |
| 6,405,625 | B1 * | 6/2002 | Nomura et al. | 83/611 |
| 6,895,847 | B2 * | 5/2005 | Muller | 83/618 |
| 7,428,859 | B2 | 9/2008 | Fujita et al. | |
| 7,434,369 | B2 | 10/2008 | Uneyama et al. | |
| 2006/0123969 | A1 * | 6/2006 | Fujita et al. | 83/697 |

FOREIGN PATENT DOCUMENTS

| | | | |
|---|---|---|---|
| CH | 537260 | * | 7/1973 |
| DE | 10 2007 007521 | A1 | 9/2007 |
| EP | 1221361 | A2 | 7/2002 |
| FR | 2617752 | A1 | 1/1989 |
| WO | 9316851 | A1 | 9/1993 |

OTHER PUBLICATIONS

PCT International Search Report for PCT/US2010/022817 mailed Aug. 10, 2010 (3 pages).

* cited by examiner

*Primary Examiner* — Stephen Choi
(74) *Attorney, Agent, or Firm* — Quarles & Brady LLP

(57) ABSTRACT

An improved guillotine cutter for a printer is disclosed. The guillotine cutter includes a guillotine blade having a cutting motion that helps to urge the cut media from the exit chute of the frame. This reduces the likelihood of the cut media becoming pulled into the frame of the cutter, requiring that the user fish the cut media out. The guillotine cutter further provides a frame having integrated bearing surfaces for supporting many of the movable components of the cutter. This minimizes the complexity of the assembly of the cutter, reducing the number of parts (by elimination of separate bearings and other such additional components) and time required to assemble the cutter.

9 Claims, 5 Drawing Sheets

GUILLOTINE CUTTER

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention generally relates to printers. In particular, this invention relates to a guillotine cutter for a printer.

Many printers print onto continuous rolls of media. As the media extends through the printer, the media typically is pulled off of a roll, fed past a print head, and fed through an exit chute on the printer. As the media is continuous as it is pulled from the roll, it occasionally needs to be cut to separate the printed portion from the rest of the roll. To sever the media from the roll, a cutter may be placed near the exit chute and actuated to cut the media.

In one type of cutter, a guillotine cutter, the media is fed through an opening between two blades. When the guillotine cutter is actuated to cut the media, one of the blades is moved past the other blade in a direction that is generally perpendicular to the travel path of the media. The blade actuation severs any media in the opening between the blades.

The media cut by the cutter is often an adhesive-backed media that is placed on a liner. Adhesive-backed media is commonly used in the printing of labels, barcodes, and the like which are attached to an object after printing. Unfortunately, cutting adhesive-backed media is particularly irksome, as the adhesive of the media tends to builds up on the blades over time.

This adhesive build-up on the blades degrades the quality of the cut over the life of the blades. In cases of extreme build-up, the blades may not completely cut the media when actuated.

The adhesive build-up on the blades may also cause the cut media to stick to the cutting edge. In a guillotine-style cutter, this sticking may result in the media not properly feeding from the exit chute, as the portion of the media severed by the cutting edge may continue to travel with the cutting edge even after the media is cut. Correcting this problem may require user intervention to retrieve any media that has not exited the cutter.

Further, although straightforward in function, cutters typically include complex assemblies with numerous parts. These assemblies may include internal frames, external frames, mounting features, bushings, spacers, and additional fasteners to mount parts. Having a complicated assembly adds cost to the cutter, increases the production time of the cutter, and adds complexity to the cutter.

Hence, a need exists for an improved cutter that reduces adhesive build-up on the blades over the life of the cutter, improves the ejection of the cut media, and minimizes the complexity of the cutter assembly.

SUMMARY OF THE INVENTION

A guillotine cutter is disclosed for selectively cutting media passing therethrough. The guillotine cutter includes a frame enclosure, a fixed blade, and a guillotine blade. The frame enclosure has a media path extending from an entrance passage to an exit chute. The fixed blade is attached to the frame enclosure. The guillotine blade is movable within the frame enclosure between a first position and a second position. In the first position, the guillotine blade defines a first angle with the media path. In the second position, the guillotine blade has slid past the fixed blade to cut the media and the guillotine blade is angularly offset from the first position and defines a second angle with the respect to the media path. A cutting edge of the guillotine blade pivots towards the exit chute to push the media through the exit chute.

In one form, the frame enclosure may have a plurality of integrated bearing surfaces formed thereon. The guillotine cutter may further include an actuator mechanism linked to the guillotine blade that actuates the guillotine blade between the first position and the second position. At least a portion of the actuator mechanism may contact the integrated bearing surfaces of the frame enclosure. The actuator mechanism may be operably connected to a motor in the frame enclosure that drives the actuator mechanism. The actuator mechanism may include a crank assembly including a pair of joined rotatable discs linked to the guillotine blade. The crank assembly may further include a pair of links that link the pair of rotatable discs to the guillotine blade. Each of the pair of links may be connected to one the pair of rotatable discs at a location not along an axis of rotation of the pair of rotatable discs.

In another form, the fixed blade may include a drafted angle for collecting an adhesive from the media.

In yet another form, the fixed blade has a coating applied thereto to reduce a coefficient of friction of the fixed blade.

In still another form, the frame enclosure may include a cleaning slot providing access to the fixed blade such that any adhesive buildup can be cleaned from the fixed blade.

In yet another form, when the guillotine blade is in the second position, the exit chute deflects the media downward, forcing the media to separate from the guillotine blade.

Other aspects of a guillotine cutter for selectively cutting media are also disclosed. A guillotine cutter includes a frame enclosure, a fixed blade, a guillotine blade, and an actuator mechanism. The frame enclosure has a media path extending from an entrance passage to an exit chute. The frame enclosure also provides a plurality of integrated bearing surfaces. The fixed blade is attached to the frame enclosure. The guillotine blade is movable within the frame enclosure between a first position defining a first angle with the media path and a second position in which the guillotine blade has slid past the fixed blade to cut the media. The actuator mechanism is linked to the guillotine blade and actuates the guillotine blade between the first position and the second position. At least a portion of the actuator mechanism contacts the integrated bearing surfaces of the frame enclosure.

In one form, in the second position, the guillotine blade may be angularly offset from the first position to form a second angle with the media path. Further, in the second position, a cutting edge of the guillotine blade may angle towards the exit chute to push the media through the exit chute. In the second position, the exit chute may deflect the media downward, forcing the media to separate from the guillotine blade.

In another form, the guillotine cutter may be modular.

In yet another form, the actuator mechanism may be operably linked to a motor in the frame enclosure that drives the actuator mechanism.

In still yet another form, the fixed blade may include a drafted angle for collecting an adhesive from the media. The fixed blade may have a coating applied thereto to reduce a coefficient of friction of the fixed blade.

In one form, the frame enclosure may include a first frame part and a second frame part. In this form, the integrated bearing surfaces include a first bearing surface from the first frame part and a second bearing surface from the second frame part.

In yet another form, the actuator mechanism may include a crank assembly including a pair of joined rotatable discs linked to the guillotine blade. The crank assembly may also include a pair of links that link the pair of rotatable discs to the guillotine blade. Each of the pair of links may be connected to one the pair of rotatable discs at a location not along an axis of rotation of the pair of rotatable discs.

Thus, an improved guillotine cutter is provided. This guillotine cutter includes a guillotine blade having a cutting motion that helps to urge the cut media from the exit chute of the cutter. This reduces the likelihood of the cut media being pulled into the frame of the cutter, requiring that the user fish the cut media out. Further, the guillotine cutter provides a frame having integrated bearing surfaces for supporting many of the movable components of the cutter. This minimizes the complexity of the assembly of the cutter, reducing the number of parts (e.g., by elimination of separate bushings and other such additional components) and the time required to assemble the cutter. This ultimately reduces the cost of producing the cutter.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
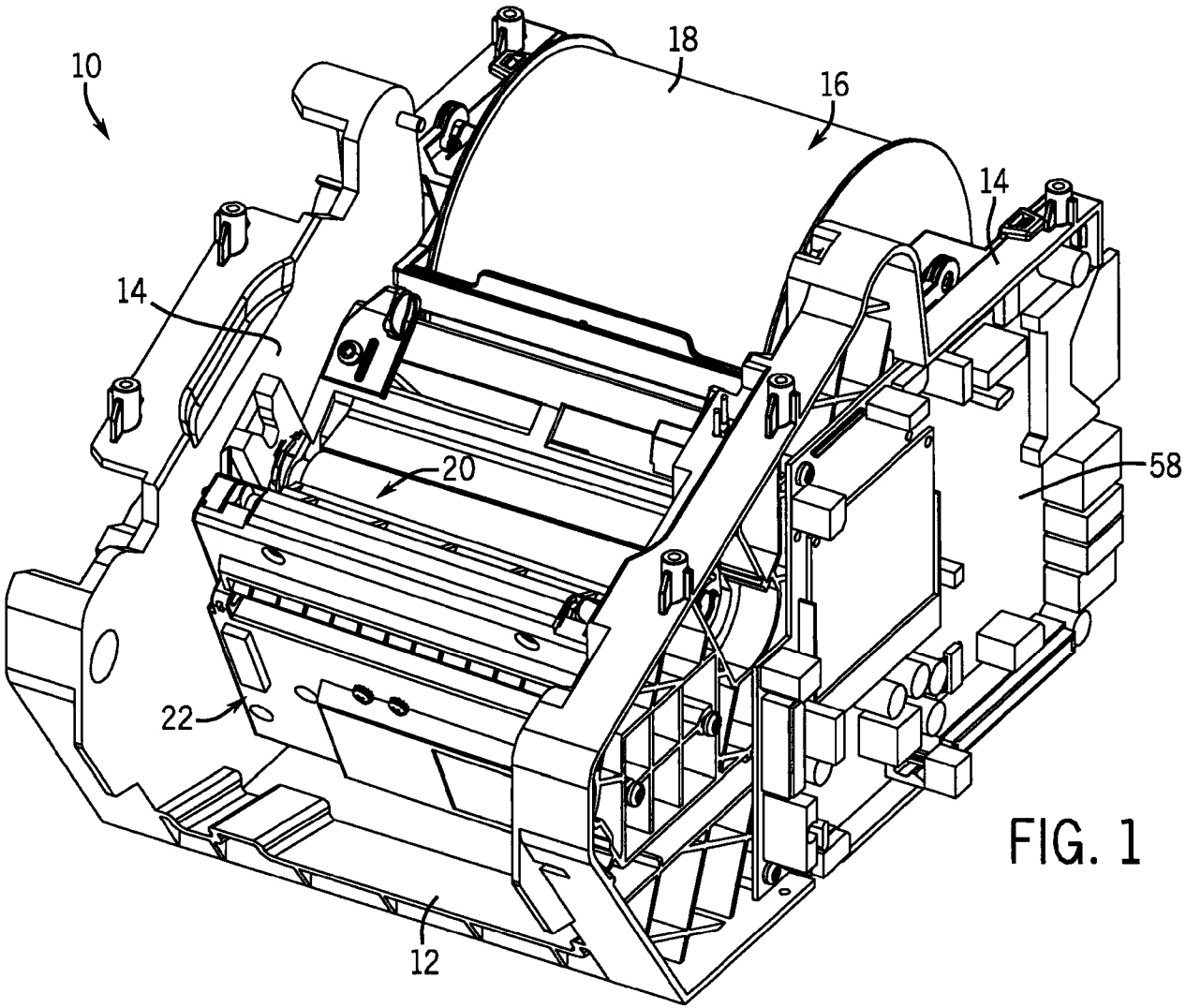
FIG. 1 is an environmental view of a guillotine cutter inserted in a carriage for a printer.

Referring first to FIG. 1, a carriage 10 for insertion in a printer is illustrated. The carriage 10 has a horizontal base wall 12 with two side walls 14 vertically extending therefrom to form a U-shaped cradle. The two side walls 14 have surfaces facing one another that include features formed thereon (e.g., slots or the like) to allow the carriage 10 to support a roll 16 having media 18 wrapped thereabout, a print head assembly 20, and a guillotine cutter 22. Most of the components supported by the carriage 10 are designed to be removed for periodic maintenance and/or for replacement after they are consumed. For example, the guillotine cutter 22 is a modular component that is removeably inserted into the carriage 10.

In general operation, the printer works as follows. Using various rollers and guides, the media 18 is fed from the roll 16 and past a print head (not shown) in the print head assembly 20. The print head prints text, an image, a barcode, or the like onto the media 18 as the media 18 passes the print head. In the form shown, this printing is done via thermal transfer of ink onto the media 18. However, in other forms, this printing could be done using other printing methods including ink jet printing, laser printing, dot matrix printing, and the like to produce the image on the media 18. Once the media 18 has been printed on, the media 18 is fed through the guillotine cutter 22. The guillotine cutter 22 cuts the media 18, as will be described in further detail below, to sever the portion of the media 18 that has been printed on from the rest of the media 18.

Figure 2:
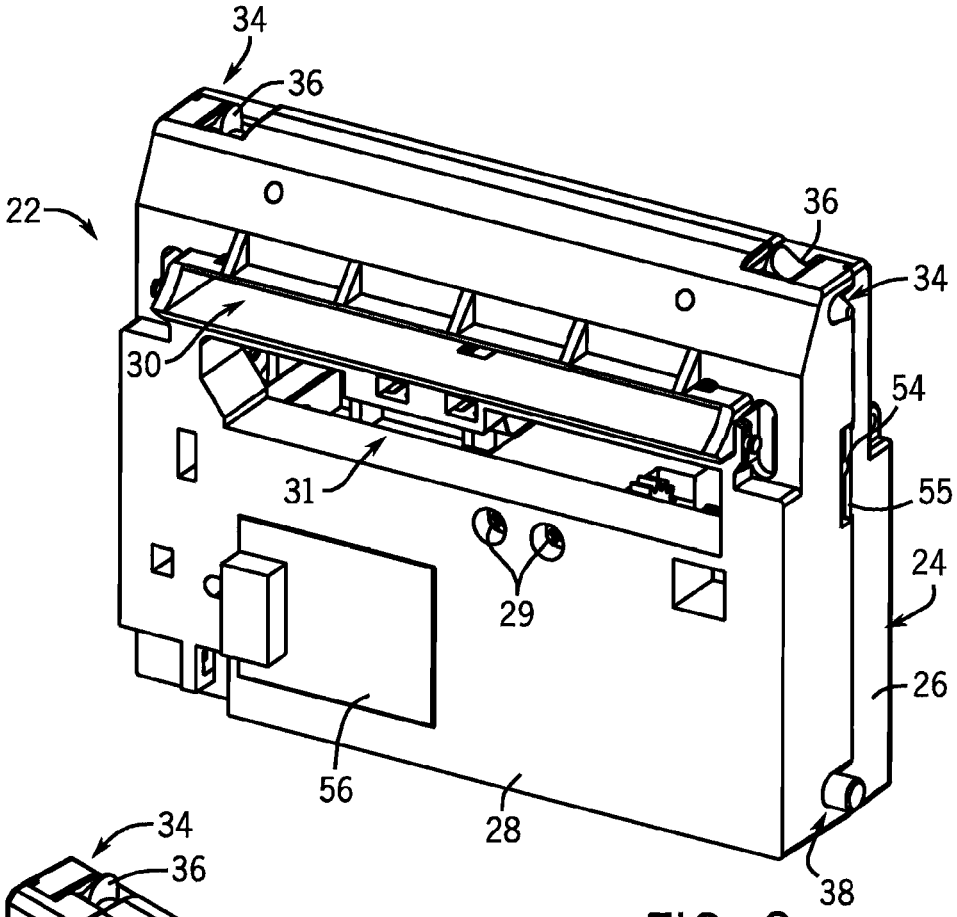
FIG. 2 is a rear-side perspective view of the guillotine cutter.
Figure 3:
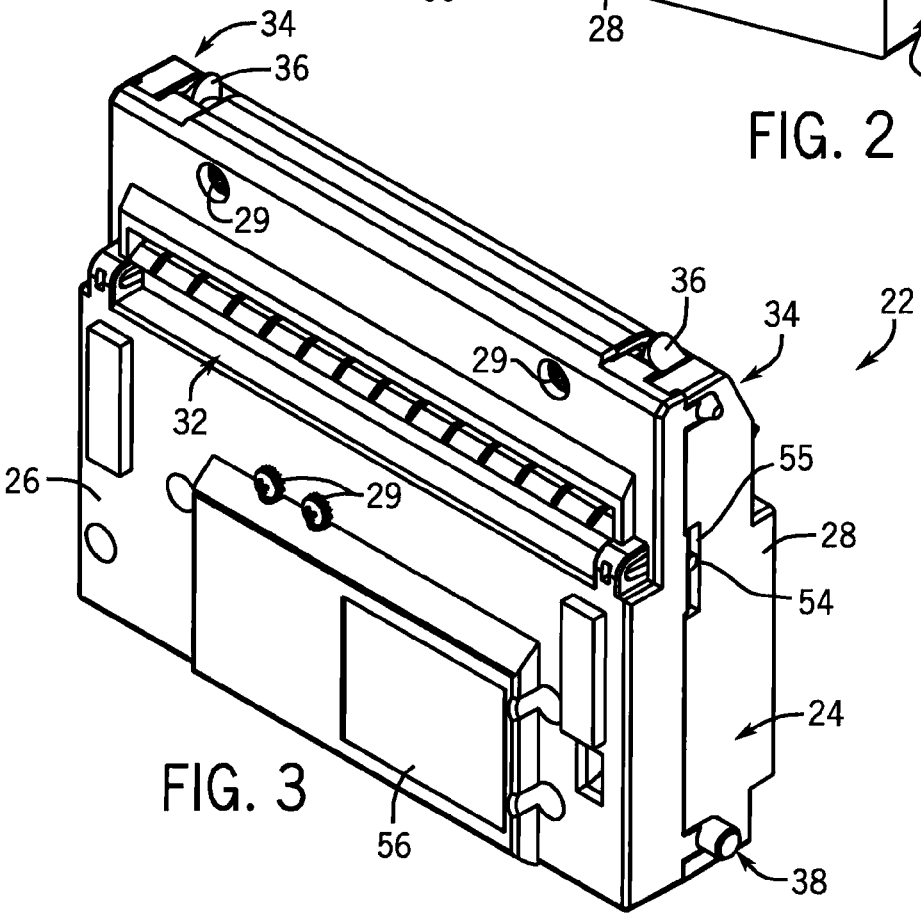
FIG. 3 is a front-side perspective view of the guillotine cutter.
Figure 5:
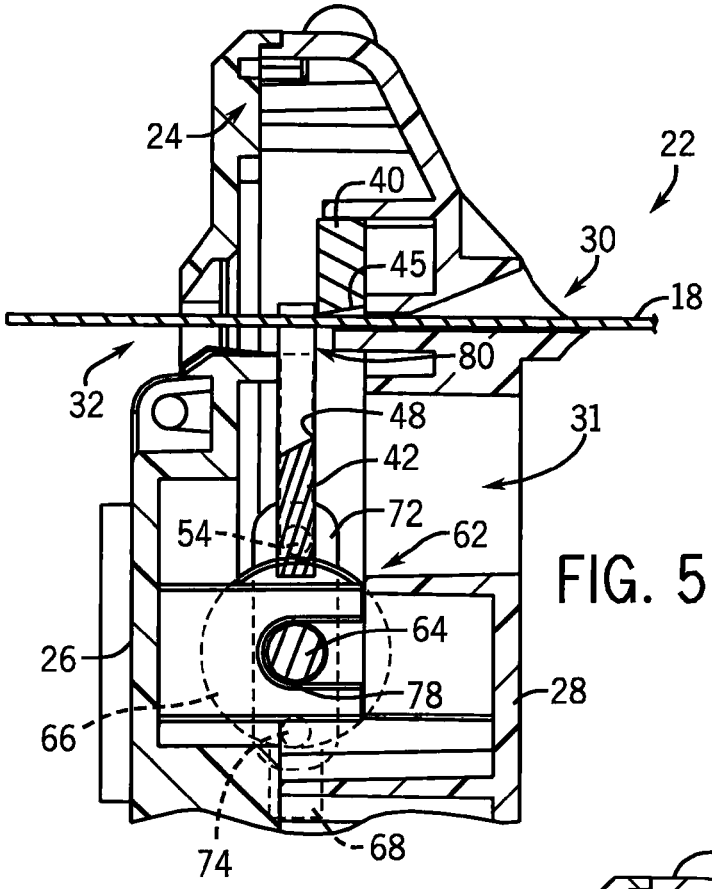
FIG. 5 is a cross-sectional side view of the guillotine cutter taken along line 5-5 of FIG. 4 in which a guillotine blade is in a lower position.

Referring now to FIGS. 2 and 3, the guillotine cutter 22 is shown removed from the carriage 10 of the printer. The guillotine cutter 22 includes a frame 24 having a front frame part 26 and a back frame part 28 enclosing the internal components of the guillotine cutter 22. The front frame part 26 and the rear frame part 28 are secured together by a set of screws 29. On the back frame part 28, an entrance slot 30 and a cleaning slot 31 are formed. On the front frame part 26, an exit chute 32 is formed. As best shown in FIG. 5, a media path extends from the entrance slot 30 to the exit chute 32. The cleaning slot 31 provides access to the blades for periodic cleaning and provides an opening to remove mis-fed media.

The guillotine cutter 22 includes laterally outwardly biased support pins for mounting the guillotine cutter 22 in recesses in the side walls 12 of the carriage 10. These support pins include a set of upper support pins 34 having a pinchable protrusion 36 and a set of lower support pins 38. Springs or the like bias the sets of support pins 34 and 38 outward. During the installation of the guillotine cutter 22 in the carriage 10, these support pins 34 and 38 are pressed inward and then snap back outward into recesses in the side walls 14 of the carriage 10 to secure the guillotine cutter 22 in the carriage 10.

The sets of support pins 34 and 38 are inserted between the front frame part 26 and the back frame part 28 during the assembly of the guillotine cutter 22. The sets of support pins 34 and 38 directly bear on the integrated bearing surfaces 39 of the frame 24. Thus, no complex installation of a support pin sub-assembly into the frame 24 is necessary during the manufacture of the guillotine cutter 22.

Figure 4:
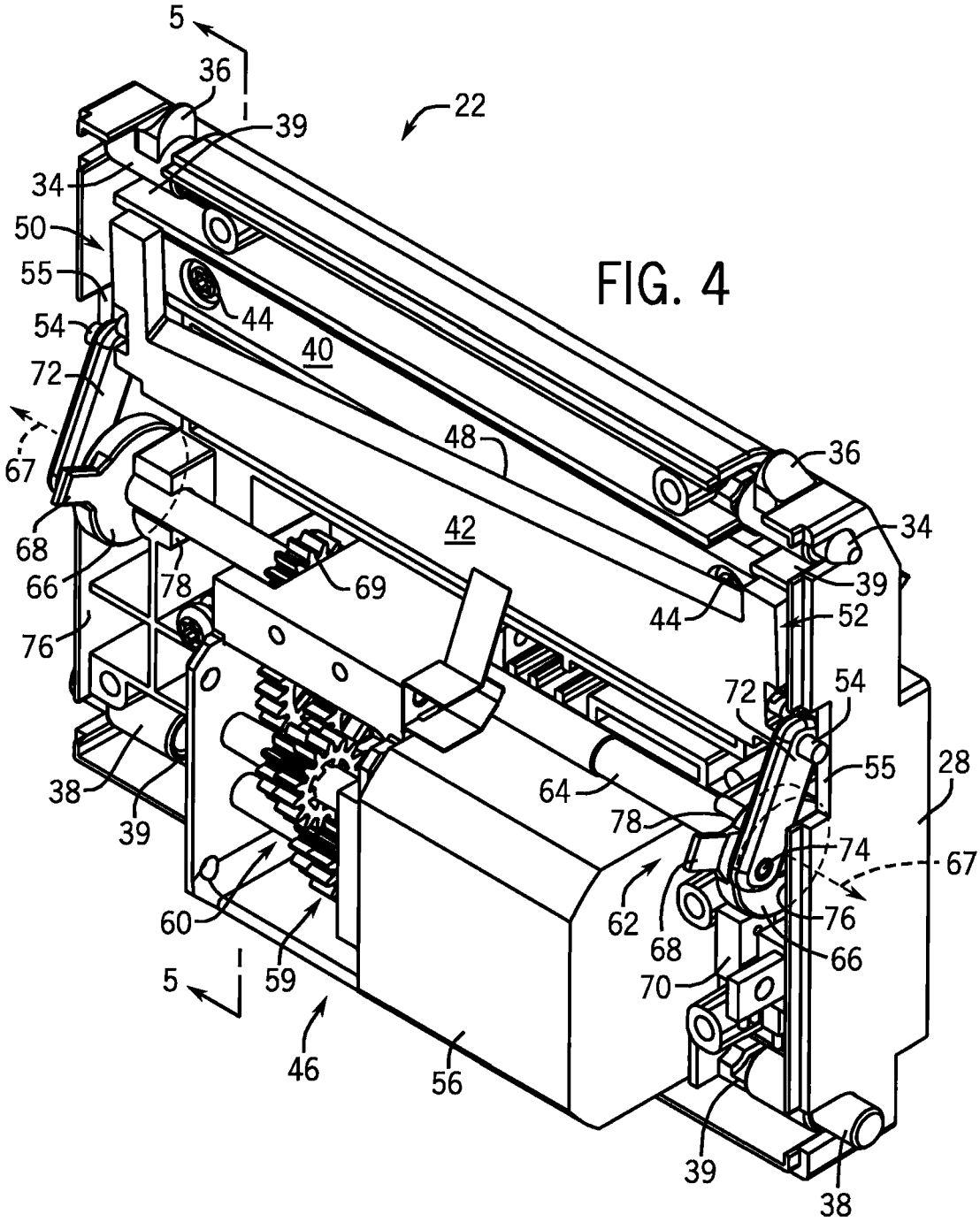
FIG. 4 is a rear-side perspective partial cross-sectional view of the guillotine cutter.

Referring now to FIG. 4, a fixed blade 40 and a guillotine blade 42 are enclosed with the frame 24. The guillotine blade 42 is linked to an actuator mechanism 46 that urges the guillotine blade 42 past the fixed blade 40 to cut the media 18 as will be described in further detail below with reference to FIGS. 5-7.

Figure 8:
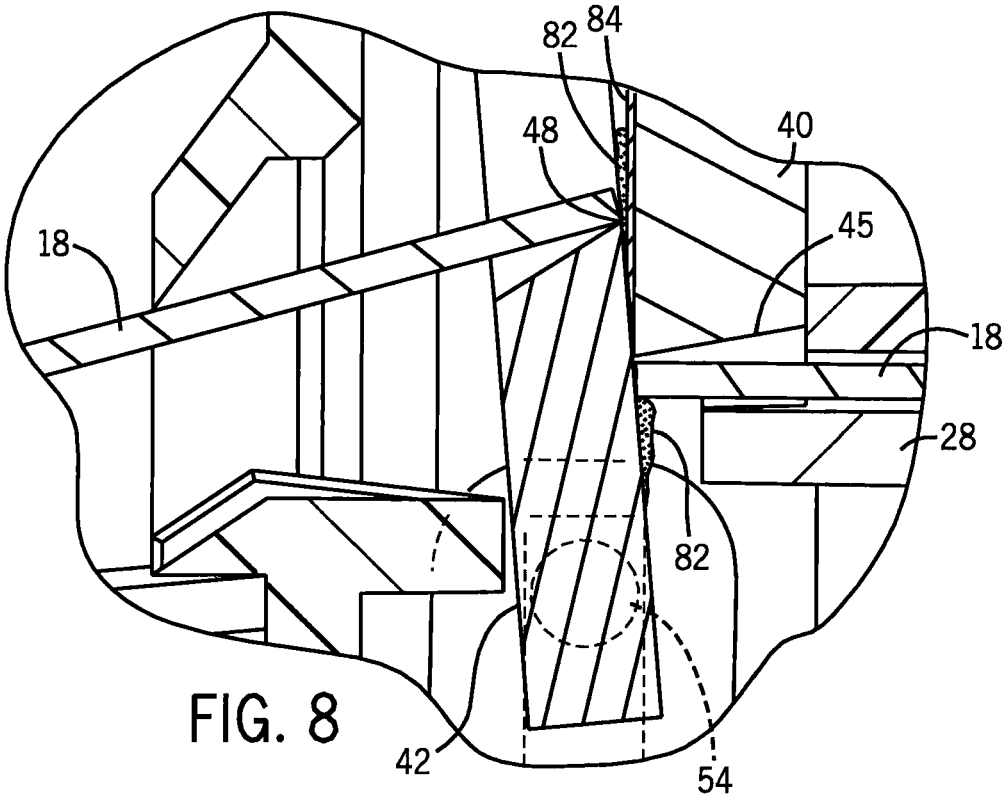
FIG. 8 is a detailed cross-sectional view taken along line 8-8 of FIG. 7 in which the build-up of adhesive on the blades is illustrated.

The fixed blade 40 is attached to the back frame part 28 by a set of screws 44. The fixed blade 40 has a drafted angle 45 as is best seen in FIG. 8, which forms a stationary cutting edge.

The guillotine blade 42 has a movable cutting edge 48 extending between a left end 50 and a right end 52 of the guillotine blade 42. The movable cutting edge 48 is angled as the guillotine blade 42 extends from the left end 50 to the right end 52 such that, as the guillotine blade 42 moves past the fixed blade 40, a cutting action between the movable cutting edge 48 and the stationary cutting edge is provided that is similar to the cutting action of a pair of scissors.

Near the bottom of each of the lateral sides of the guillotine blade 42, a set of shaft-like projections 54 are formed on either end of the guillotine blade 42 for connection to the actuator mechanism 46. These projections 54 also extend through a set of slots 55 formed along the lateral connection seam between the front frame part 26 and the back frame part 28.

In the form shown, the actuator mechanism 46 includes a number of components. The actuator mechanism 46 includes an electric motor 56 which is secured between the front frame part 26 and the back frame part 28 and is viewable from the outside of the guillotine cutter 22 for connection to a power supply (not shown) and a control board 58 (shown in FIG. 1 as being mounted to an outwardly-facing surface of one of the two side walls 14 of the carriage 10). The electric motor 56 has an output shaft 59 which drives a gear train 60 comprising multiple shafts with gears thereon. One of the gears of the gear train 60 drives the rotation of a crank assembly 62.

The crank assembly 62 transfers the motion of the gear train 60 to the guillotine blade 42. The crank assembly 62 includes a shaft 64 having discs 66 attached to each end. A gear 69 attached to the shaft 64 intermeshes with at least one of the gears on the gear train 60 to cause the rotation of the shaft 64 about the axis of rotation 67. In the form shown, the discs 66 on each end of the shaft 64 have a tab 68 formed thereon that turns with the motion of the disc 66 and shaft 64. During the rotation of the discs 66 and shaft 64, this tab 68 may travel past a sensor 70 to determine the position of the crank assembly 62.

A set of links 72 in the crank assembly 62 connect each of the discs 66 to the guillotine blade 42. One of the ends of each of the links 72 is attached to one of the projections 54 on the guillotine blade 42. The other end of each of the links 72 is attached to a projection 74 formed on each of the discs 66. The projection 74 is located at a distance from the axis of rotation 67. Given the connectivity of the set of links 72 to the discs 66 and the guillotine blade 42, the set of links 72 act as a crank which translates the rotation of the shaft 64 and discs 66 to a linear driving motion of the guillotine blade 42 at the projection 54.

A number of integrated bearing surfaces support the crank assembly 62. Notably, in the form shown, the set of links 72 are held on the projections 54 of the guillotine blade 42 and the projections 74 of the discs 66 by a set of integrated bearing surfaces 76 on lateral walls the frame 24. During assembly of the guillotine cutter 22, the set of links 72 are slid over the projections 54 and 74 and inserted between the front frame part 26 and the back frame part 28, which are then joined together. When the front frame part 26 and the back frame part 28 are joined, the crank assembly 62 is enclosed by the frame parts 26 and 28. The set of integrated bearing surfaces 76 are formed on the lateral walls of the frame parts 26 and 28 prevent the set of links 72 from falling off of the projections 54 and 74. Further, a set of integrated bearing surfaces 78 support the shaft 64 of the crank assembly 62. As the shaft 64 rotates, the surface of the shaft 64 and the integrated bearing surfaces 78 engage one another.

The inclusion of the integrated bearing surfaces 39, 76, and 78 reduce the number of components required in the assembly of the guillotine cutter 22. The various components of the guillotine cutter 22 are simply assembled and placed into the frame parts 26 and 28, which are then joined. To improve the performance of the integrated bearing surfaces 39, 76 and 78, the frame parts 26 and 28 are fabricated from a material having a low coefficient of friction. All of the bearing surfaces for the components are surfaces of the front frame parts 26 and/or the back frame part 28, eliminating the need for separate bushings, lubrication, spacers, and the like, which add cost and complexity to the assembly.

Figure 6:
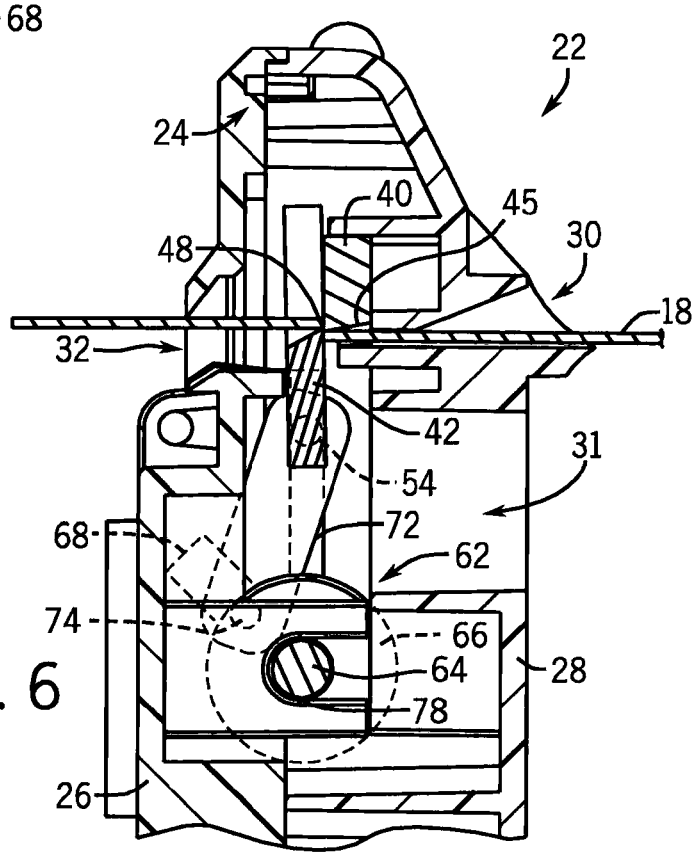
FIG. 6 is a cross-sectional side view similar to FIG. 5, but in which the guillotine blade is at an intermediate position in which the guillotine blade is cutting the media.
Figure 7:
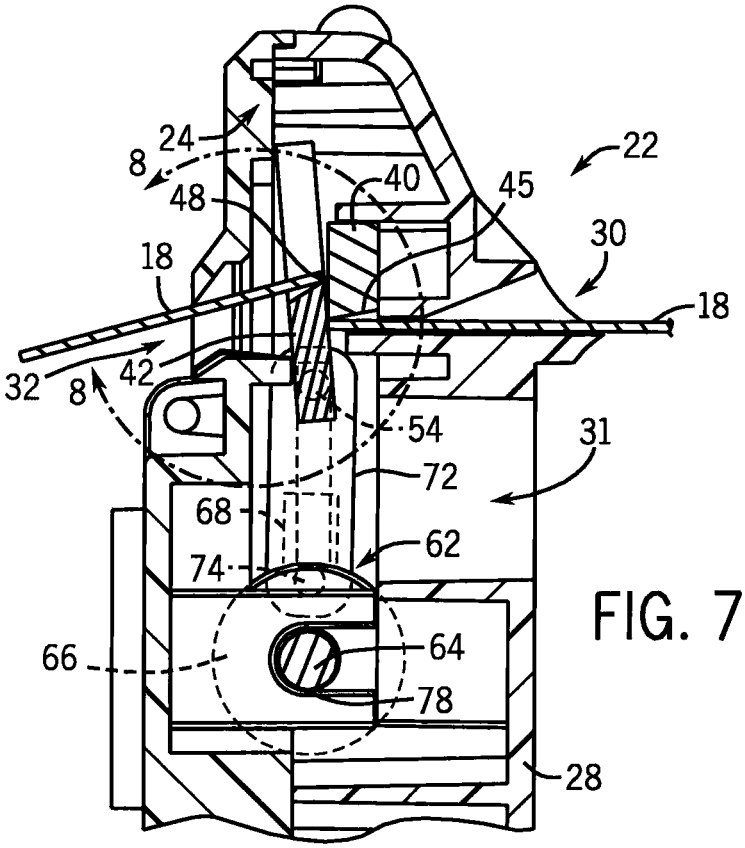
FIG. 7 is a cross-sectional side view similar to FIG. 5, but in which the blade has been moved to the upper position in which the media has been fully cut.

Referring now to FIGS. 5-7, the cutting operation is illustrated.

In FIG. 5, the guillotine blade 42 is in a lower position in which the media 18 can pass though an opening 80 between the fixed blade 40 substantially perpendicular to the media path and the guillotine blade 42. Typically, when the media 18 is being printed on, the guillotine blade 42 is in this lower position, such that the media 18 can be fed though the opening 80.

In FIG. 6, the guillotine blade 42 is lifted to a position in which the movable cutting edge 48 of the guillotine blade 42 passes the fixed blade 40 to cut the media 18. This movement of the guillotine blade 42 occurs when the electric motor 56 drives the operation of the gear train 60, which drives rotation of the shaft 64 and discs 66, which drives the upward movement of the set of links 72, which in turn drives the upward movement of the guillotine blade 42.

Referring now to FIG. 7, the guillotine blade 42 has been actuated to an upper position in which the guillotine blade 42 has fully severed the portion of the media 18 that has been printed on from the rest of the media 18. Once the cutting of the media 18 is complete, the electric motor 56 continues to drive the mechanism to the lower position of FIG. 5 to re-establish the opening 80 for the passage of the media 18. In the form shown, the motor is driven in one direction through the entire cut cycle.

Notably in FIG. 7, as the guillotine blade 42 approaches the upper position, the guillotine blade 42 tilts or pivots towards the exit chute 32 defining a non-perpendicular angle with the media path. As the guillotine blade 42 tilts or pivots towards the exit chute 32, the guillotine blade 42 is angularly offset from the orientation of the guillotine blade 42 in the lower position as shown in FIG. 5. In the form shown, this can occur as the guillotine blade 42 is pivotally fixed at its bottom end at the connection between the projections 54 and the set of links 72, while the top end (closest to the movable cutting edge 48) is not connected to anything and "floats". A portion of the frame 24 or some other biasing mechanism may cause this tilting or pivoting as the guillotine blade 42 is raised.

This tilting or pivoting of the movable cutting edge 48 of the guillotine blade 42 toward the exit chute 32 helps to separate the cut media from the guillotine blade 42 by slightly increasing the contact angle between the media 18 and the movable cutting edge 48 of the guillotine blade 42. When an adhesive is present in the media 18, this tilting or pivoting assists in separating the media 18 from the guillotine blade 42 if the some of the adhesive from the media 18 sticks to the movable cutting edge 48 of the guillotine blade 42.

Additionally, the exit chute 32 is formed such that the media 18 exiting the exit chute 32 is forced downward, encouraging the separation of the media 18 that has been cut from the guillotine blade 42. The exit chute 32 has a top lip above the opening that slopes downward as it extends away from the frame 24. If and when the cut media contacts this top lip, usually in the event that the cut media sticks to the guillotine blade 42, the cut media is forced downward by the top lip of the exit chute 32.

Further, the tilting or pivoting of the guillotine blade 42 assists in pushing or urging the media 18 through the exit chute 32. This reduces the likelihood of the media 18 becoming stuck in the guillotine cutter 22 or not properly ejecting from the exit chute 32.

Referring now to FIG. 8, a detailed view shows the build-up of adhesive 82 on the fixed blade 40 and the guillotine blade 42. The adhesive primarily collects on the vertical face of the fixed blade 40 and the back face of the guillotine blade 42. The vertical face of the fixed blade 40 is coated with a coating 84 having a low coefficient of friction such that the collected built-up adhesive 82 creeps up the fixed blade 40 away from the cutting edge. As the cutting edge 48 of the guillotine blade 42 swings away from the vertical face of the fixed blade 40, this provide a space on the fixed blade 40 for the adhesive 82 to build up. Further, as the guillotine blade 42 moves past the fixed blade 40, the edge of the fixed blade 40 slides along the back face of the guillotine blade 42 pushing the adhesive down the back face and away from the cutting edge 48. The collected adhesive on the back side of the guillotine blade 42 may be periodically removed by the user through the cleaning slot 31.

It should be appreciated that while a guillotine cutter has been described having a guillotine blade that is raised to cut the media, in other forms the guillotine blade could be lowered to cut the media. If the guillotine blade is lowered, then it is contemplated that the cutting edge of the guillotine blade may be likewise tilted or pivoted towards the exit chute to assist in the separation of the cut media from the guillotine blade and to urge the cut media out of the exit chute.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A guillotine cutter for selectively cutting a media passing therethrough, the guillotine cutter comprising:

a frame enclosure having a media path extending from an entrance passage to an exit chute;

a fixed blade attached to the frame enclosure;

a guillotine blade movable within the frame enclosure between a first position defining a first angle with the media path and a second position defining a second angle with the media path that is angularly offset from the first position in which the guillotine blade has slid past the fixed blade to cut the passing therebetween and in which a cutting edge of the guillotine blade pivots towards the exit chute to push the media through the exit chute; and an actuator mechanism linked to the guillotine blade that actuates the guillotine blade between the first position and the second position, the actuator mechanism including a crank assembly including a pair of joined rotatable discs linked to the guillotine blade by a pair of links that link the pair of rotatable discs to the guillotine blade, each of the pair of links connected to one the pair of rotatable discs at a location not along an axis of rotation of the pair of rotatable discs;

wherein the crank assembly is enclosed by the frame enclosure and the frame enclosure has a plurality of integrated bearing surfaces formed thereon including a first set of integrated bearing surfaces formed on lateral walls of the frame enclosure that maintain a connection of each of the pair of links to one of the pair of rotatable discs.

2. The guillotine cutter of claim 1, wherein at least a portion of the actuator mechanism contacts the integrated bearing surfaces of the frame enclosure.

3. The guillotine cutter of claim 2, wherein the actuator mechanism is operably connected to a motor in the frame enclosure that drives the actuator mechanism.

4. The guillotine cutter of claim 1, wherein the fixed blade includes a drafted angle for collecting an adhesive from the media.

5. The guillotine cutter of claim 1, wherein the fixed blade has a coating applied thereto to reduce a coefficient of friction of the fixed blade.

6. The guillotine cutter of claim 1, wherein the frame enclosure includes a cleaning slot providing access to the fixed blade such that any adhesive buildup can be cleaned from the fixed blade.

7. The guillotine cutter of claim 1, wherein, when the guillotine blade is in the second position, the exit chute deflects the media downward, forcing the media to separate from the guillotine blade.

8. The guillotine cutter of claim 1, wherein the crank assembly further includes a shaft having the pair of joined rotatable discs attached to the ends thereof and wherein the plurality of integrated bearing surfaces further include a second set of integrated bearing surfaces that support and engage the shaft of the crank assembly.

9. The guillotine cutter of claim 1, wherein each of the pair of links are held on a projection of the one of the pair of rotatable discs and a projection on the guillotine blade by the first set of integrated bearing surfaces.

* * * * *